US011125508B2

(12) United States Patent
Wu

(10) Patent No.: US 11,125,508 B2
(45) Date of Patent: Sep. 21, 2021

(54) THIN HEAT PIPE STRUCTURE

(71) Applicant: ASIA VITAL COMPONENTS CO., LTD., New Taipei (TW)

(72) Inventor: Chun-Ming Wu, New Taipei (TW)

(73) Assignee: Asia Vital Components Co., Ltd., New Taipei (TW)

( * ) Notice: Subject to any disclaimer, the term of this patent is extended or adjusted under 35 U.S.C. 154(b) by 0 days.

(21) Appl. No.: 16/190,176

(22) Filed: Nov. 14, 2018

(65) Prior Publication Data

US 2019/0078844 A1 Mar. 14, 2019

Related U.S. Application Data

(62) Division of application No. 14/538,822, filed on Nov. 12, 2014, now abandoned.

(51) Int. Cl.
*F28D 15/04* (2006.01)
*F28D 15/02* (2006.01)

(52) U.S. Cl.
CPC ..... *F28D 15/04* (2013.01); *F28D 15/0233* (2013.01); *F28D 15/046* (2013.01)

(58) Field of Classification Search
CPC ..... F28D 15/00; F28D 15/0233; F28D 15/04; F28D 15/043; F28D 15/046; H01L 23/427; F28F 13/08
USPC ..... 165/104.21, 104.26, 104.31, 104.33; 361/700, 701
See application file for complete search history.

(56) References Cited

U.S. PATENT DOCUMENTS 6,812,563 B2 * 11/2004 Go ..... H01L 23/473 257/712
6,957,692 B1 * 10/2005 Win-Haw ..... F28D 15/0233 165/104.21
7,845,394 B2 * 12/2010 Chang ..... F28D 15/046 165/104.21
7,950,445 B2 * 5/2011 Cheng ..... F28D 15/0275 165/104.33
2006/0144565 A1 * 7/2006 Tsai ..... F28D 15/0233 165/104.26

(Continued)

FOREIGN PATENT DOCUMENTS

CN 203704740 U 7/2014
JP 2011122789 A * 6/2011 ..... F28D 15/046

(Continued)

*Primary Examiner* — Len Tran
*Assistant Examiner* — Gustavo A Hincapie Serna
(74) *Attorney, Agent, or Firm* — Thomas J. Nikolai; DeWitt LLP

(57) ABSTRACT

A thin heat pipe structure includes a main body having a chamber. The chamber has a wick structure and a working fluid provided therein, and internally defines an evaporating section and at least one condensing section. The condensing section is extended towards at least one or two ends of the evaporating section. The wick structure is provided with at least one groove. The groove is extended through the wick structure along a thickness direction of the main body to connect to two opposite wall surfaces of the chamber, and also extended along a length direction of the main body to communicate with the condensing section and the evaporating section. With these arrangements, the thin heat pipe structure has an extremely small overall thickness and is flexible.

2 Claims, 9 Drawing Sheets

(56) References Cited

U.S. PATENT DOCUMENTS

2007/0235165 A1* 10/2007 Liu ..... F28F 13/08 165/104.26
2008/0041565 A1* 2/2008 Yang ..... F28D 15/046 165/104.26
2008/0216994 A1* 9/2008 Lee ..... H01L 23/427 165/104.26
2009/0020274 A1* 1/2009 Kawabata ..... F28D 15/0233 165/168
2009/0032227 A1* 2/2009 Krassowski ..... C04B 41/009 165/104.26
2009/0166003 A1* 7/2009 Lai ..... F28D 15/0233 165/104.26
2009/0166008 A1* 7/2009 Lai ..... H01L 23/427 165/104.33
2009/0166855 A1* 7/2009 Chiu ..... H01L 23/3675 257/715
2009/0294104 A1* 12/2009 Lin ..... F28D 15/0233 165/104.26
2010/0263835 A1* 10/2010 Wang ..... F28D 15/0266 165/104.26
2011/0308772 A1* 12/2011 Tsuruta ..... H01L 23/427 165/104.26
2012/0031588 A1* 2/2012 Huang ..... F28D 15/046 165/104.26
2012/0186784 A1* 7/2012 Yang ..... F28D 15/0266 165/104.21
2012/0211202 A1* 8/2012 Wu ..... F28D 15/0233 165/104.26
2013/0025829 A1* 1/2013 Huang ..... F28D 15/0233 165/104.26
2013/0160977 A1* 6/2013 Fan ..... F28D 15/04 165/104.26
2016/0019990 A1* 1/2016 Mochizuki ..... G21C 19/07 376/299

FOREIGN PATENT DOCUMENTS

TW 200741161 A 11/2007
TW 201144739 A1 12/2011
TW 20121973 A1 5/2012
TW M453123 U1 5/2013

* cited by examiner

THIN HEAT PIPE STRUCTURE

The present application is a division of U.S. patent application Ser. No. 14/538,822, filed on Nov. 12, 2014.

FIELD OF THE INVENTION

The present invention relates to a thin heat pipe structure, and more specifically, to a thin heat pipe structure that has an extremely small overall thickness.

BACKGROUND OF THE INVENTION

The currently available electronic mobile devices have become extremely thin and light. Apart from being thin and light, the new-generation electronic mobile devices have also largely improved computation performance. Due to the improved computation performance and the largely reduced overall thickness, an internal space of the electronic mobile devices for disposing electronic elements is also limited. The higher the computation performance is, the more amount of heat the electronic elements produce during operation. Therefore, heat dissipation elements are widely used to dissipate the heat produced by the electronic elements. Since it is difficult to provide cooling fans or other heat dissipation elements in such an extremely narrow internal space of the electronic mobile devices, copper sheets or aluminum sheets are usually used to increase the heat dissipation area. However, these arrangements have only very limited effect in improving the whole heat dissipation performance of the electronic mobile devices.

Also, other than the advancement in the electronic mobile devices, a great deal of progress has also been made in wearable smart devices. Wearable smart devices, such as smart watches, smart necklaces, smart rings and the like, are accessories with smart display interface and touch function and can be worn on the user's body. The wearable smart devices are thinner than the electronic mobile devices, so it is quite hard to provide heat dissipation elements in their internal space to dissipate heat. For example, the space in the smart watch is too narrow to mount general heat pipe or vapor chamber that provides relative good heat dissipation effect. Moreover, since the smart watch has a curvature and will be bent when being worn, the conventional rigid heat pipe or vapor chamber just could not be applied thereto. Therefore, it is desirable to adapt the conventional heat pipe or vapor chamber to the wearable smart devices.

Furthermore, in the conventional technique, when the heat pipe or vapor chamber is made with a thin configuration, the vapor passageway in the heat pipe or vapor chamber is also extremely reduced in size or even omitted to largely adversely affect the whole vapor/liquid circulation efficiency in the heat pipe or vapor chamber. In conclusion, it is an important issue at the present time as how to improve the vapor/liquid circulation in the very thin heat pipe and vapor chamber.

SUMMARY OF THE INVENTION

To solve the above problems, a primary object of the present invention is to provide a thin heat pipe structure that is flexible and has an extremely small overall thickness.

To achieve the above and other objects, the present invention provides a thin heat pipe structure including a main body.

The main body includes a chamber. The chamber has a wick structure and a working fluid provided therein, and internally defines an evaporating section and at least one condensing section. The condensing section is extended towards at least one or two ends of the evaporating section. The wick structure is provided with at least one groove. The groove is extended through the wick structure along a thickness direction of the main body to connect to two opposite wall surfaces of the chamber, and also extended along a length direction of the main body to communicate with the condensing sections and the evaporating section.

With these arrangements, the thin heat pipe structure of the present invention can reserve an internal space for maintaining smooth vapor/liquid circulation. Furthermore, since the heat pipe is largely reduced in its overall thickness, it not only can be used in a narrow space, but also can be freely bent by an external force.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
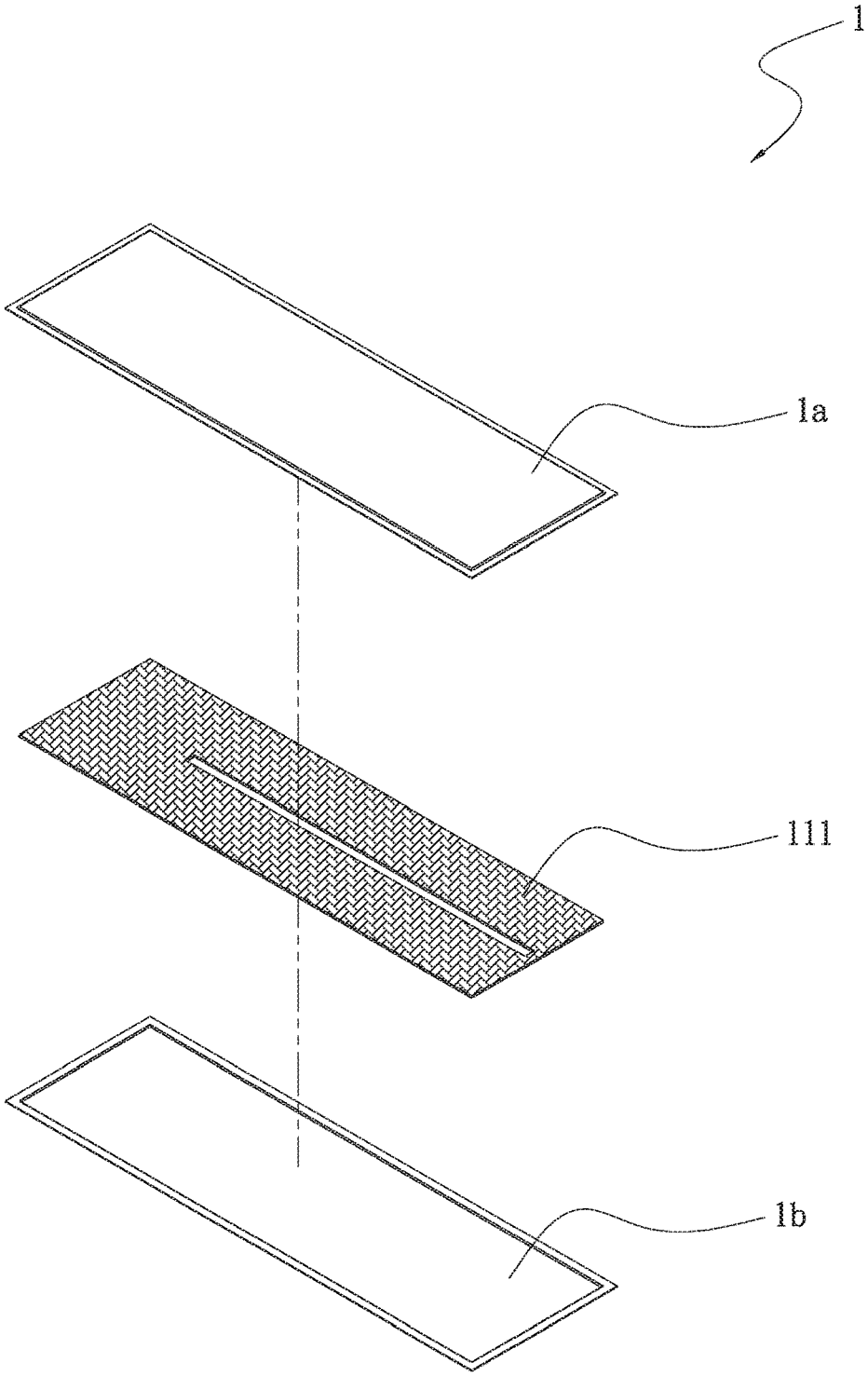
FIG. 1 is an exploded perspective view of a first embodiment of a thin heat pipe structure according to the present invention.

The present invention will now be described with some preferred embodiments thereof and by referring to the accompanying drawings. For the purpose of easy to understand, elements that are the same in the preferred embodiments are denoted by the same reference numerals.

Figure 2:
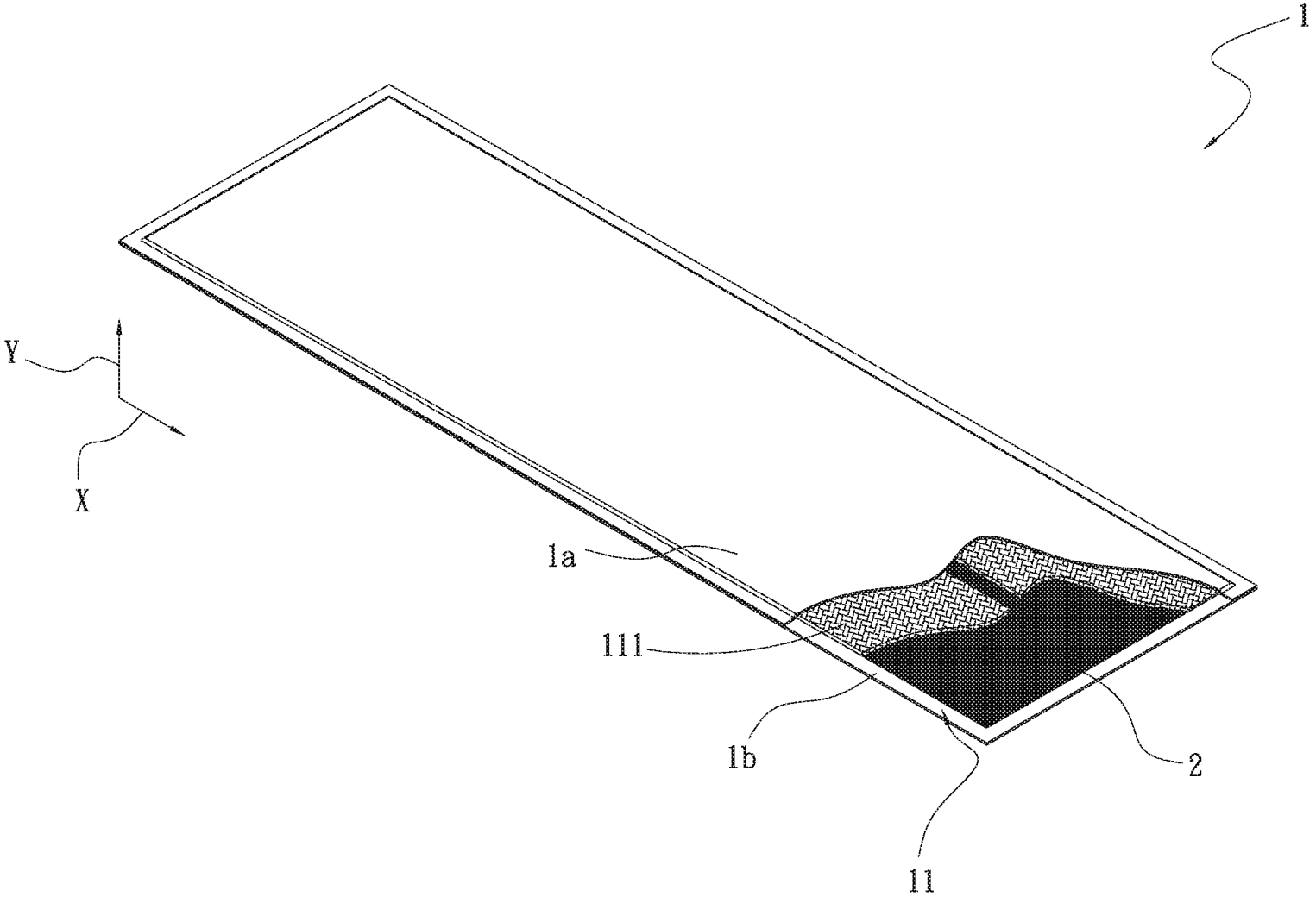
FIG. 2 is an assembled and partially sectioned perspective view of FIG. 1.
Figure 3:
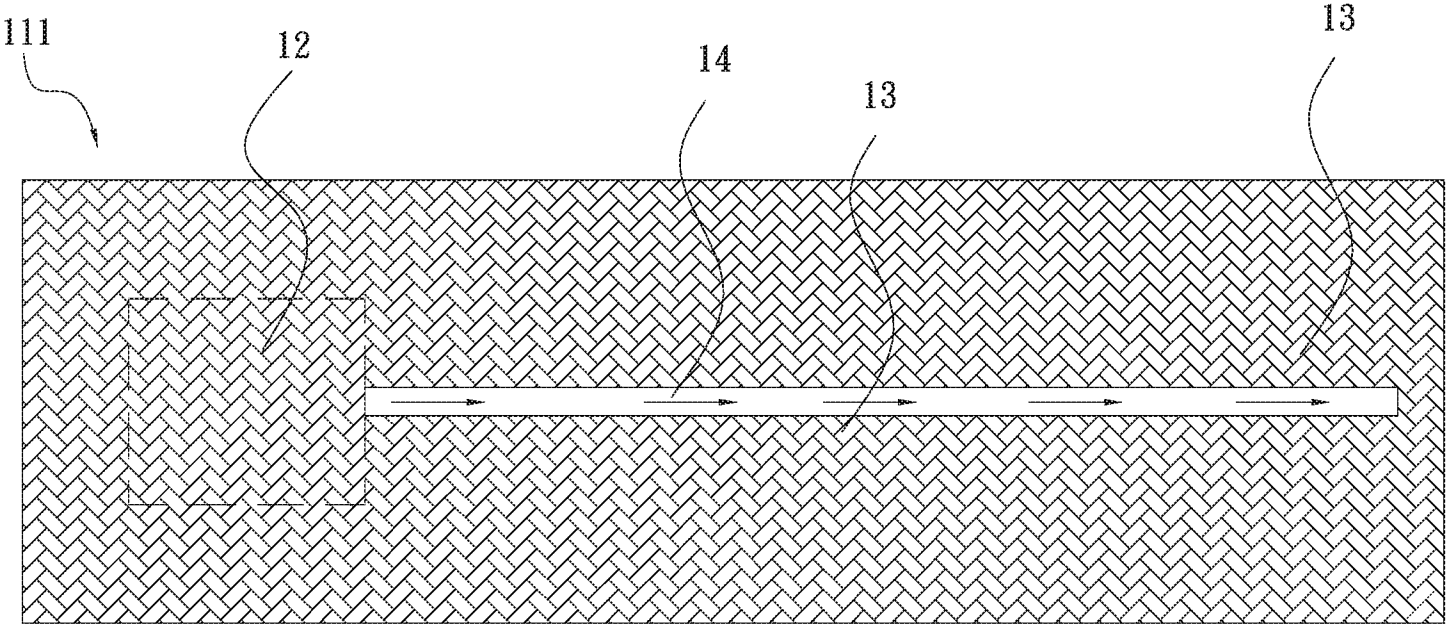
FIG. 3 is an assembled sectional view of the thin heat pipe structure according the first embodiment of the present embodiment.

Please refer to FIGS. 1 to 3, which are exploded perspective view, assembled and partially sectioned perspective view, and assembled sectional view, respectively, of a thin heat pipe structure according to a first embodiment of the present invention. As shown, the thin heat pipe structure includes a main body 1.

The main body 1 includes a chamber 11. The chamber 11 has at least one wick structure 111 and a working fluid 2 provided therein, and internally defines an evaporating section 12 and at least one condensing section 13. The condensing section 13 is extended towards at least one or two ends of the evaporating section 12. The wick structure 111 is provided with at least one groove 14. The groove 14 is extended through the wick structure 111 along a thickness direction Y of the main body 1 to connect to two opposite wall surfaces of the chamber 11, and also extended along a length direction X of the main body 1 to communicate with the condensing section 13 and the evaporating section 12. In the first embodiment, the groove 14 has a uniform width.

Figure 4:
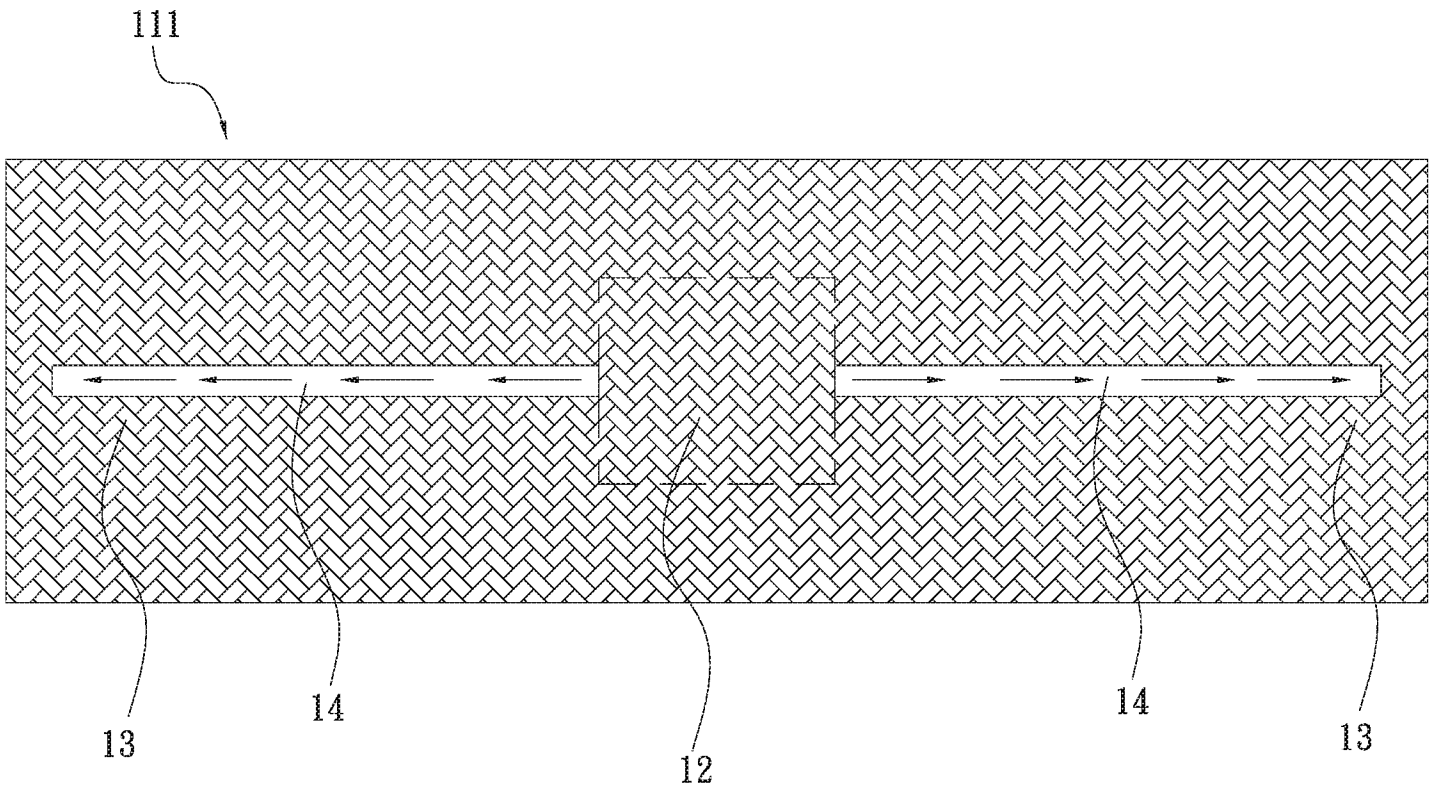
FIG. 4 is an assembled sectional view of the thin heat pipe structure according to a second embodiment of the present embodiment.

Please refer to FIG. 4, which is an assembled sectional view of the thin heat pipe structure according to a second embodiment of the present embodiment. As shown, the second embodiment of the thin heat pipe structure is generally structurally similar to the first embodiment except that, in this second embodiment, there are two condensing sections 13 respectively extended from two ends of the evaporating section 12, and the groove 14 is extended through the wick structure 111 in the condensing sections 13 along the thickness direction Y of the main body 1 (as defined in FIG. 2), but not through the wick structure 111 in the evaporating section 12.

Figure 5:
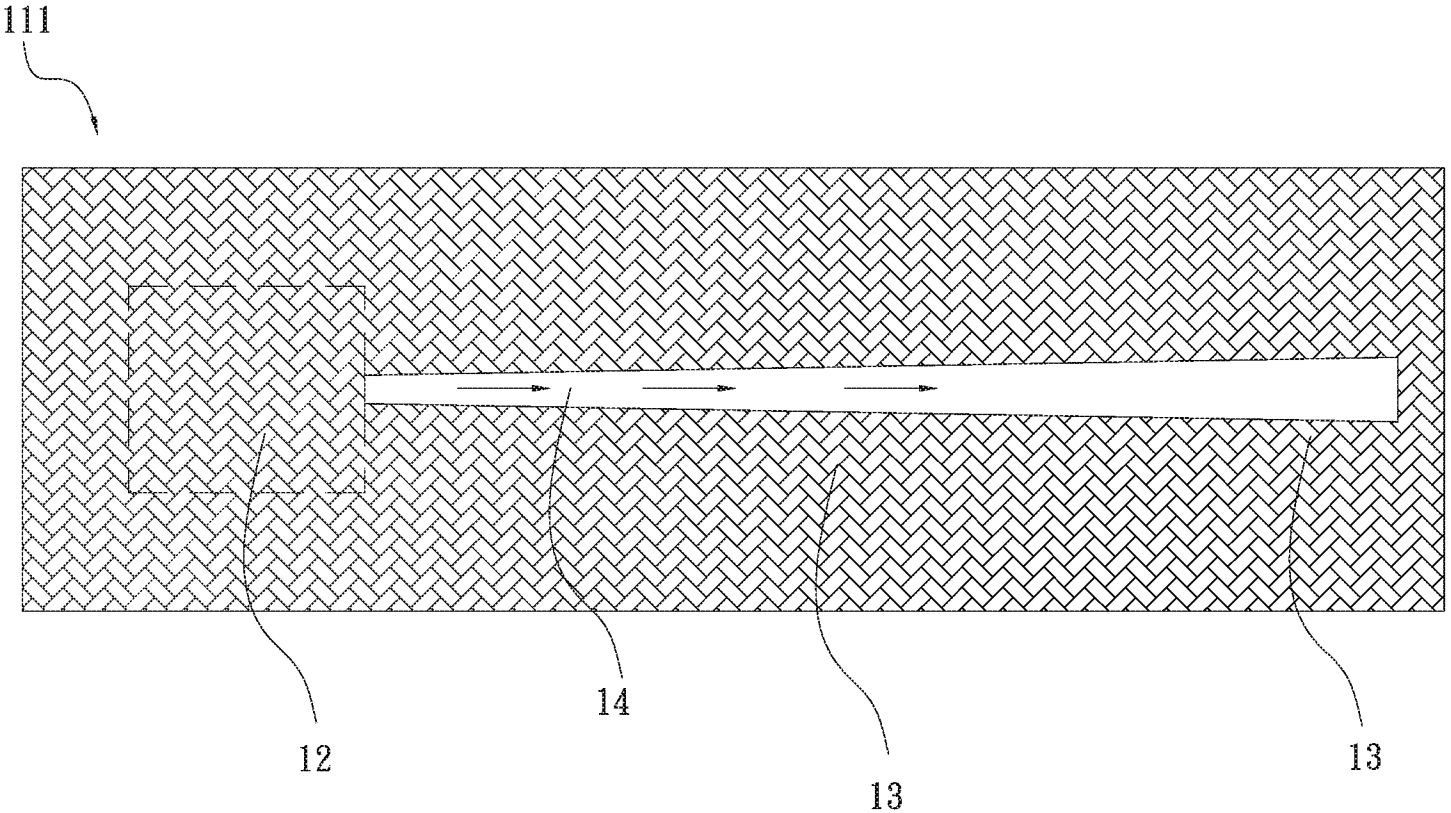
FIG. 5 is an assembled sectional view of the thin heat pipe structure according to a third embodiment of the present embodiment.

Please refer to FIG. 5, which is an assembled sectional view of the thin heat pipe structure according to a third embodiment of the present embodiment. As shown, the third embodiment of the thin heat pipe structure is generally structurally similar to the first embodiment except that, in this third embodiment, the width of the groove 14 is gradually increased from the evaporating section 12 towards the condensing section 13. That is, the width of the groove 14 in the evaporating section 12 is smaller than that of the groove 14 in the condensing section 13, which means that the groove 14 used as a vapor passageway has a gradually increased width towards the condensing section 13.

Figure 6:
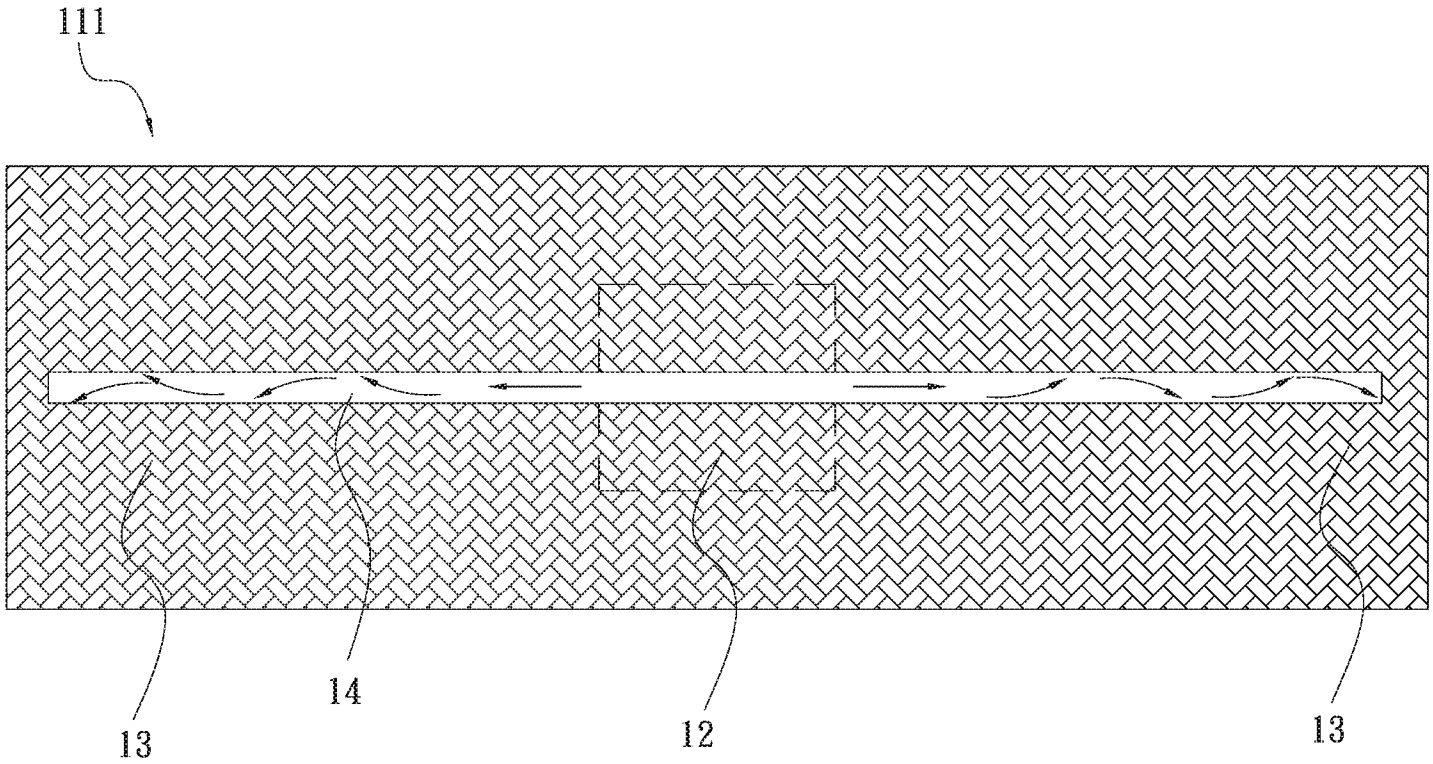
FIG. 6 is an assembled sectional view of the thin heat pipe structure according to a fourth embodiment of the present embodiment.

Please refer to FIG. 6, which is an assembled sectional view of the thin heat pipe structure according to a fourth embodiment of the present embodiment. As shown, the fourth embodiment of the thin heat pipe structure is generally structurally similar to the first embodiment except that, in this fourth embodiment, there are two condensing sections 13 respectively extended from two ends of the evaporating section 12, and the groove 14 is extended through not only the main body 1 along the length direction X, but also the wick structure 111 in the condensing sections 13 and the evaporating section 12 along the thickness direction Y of the main body 1 (as defined in FIG. 2). In the fourth embodiment, the groove 14 has a uniform width.

Figure 7:
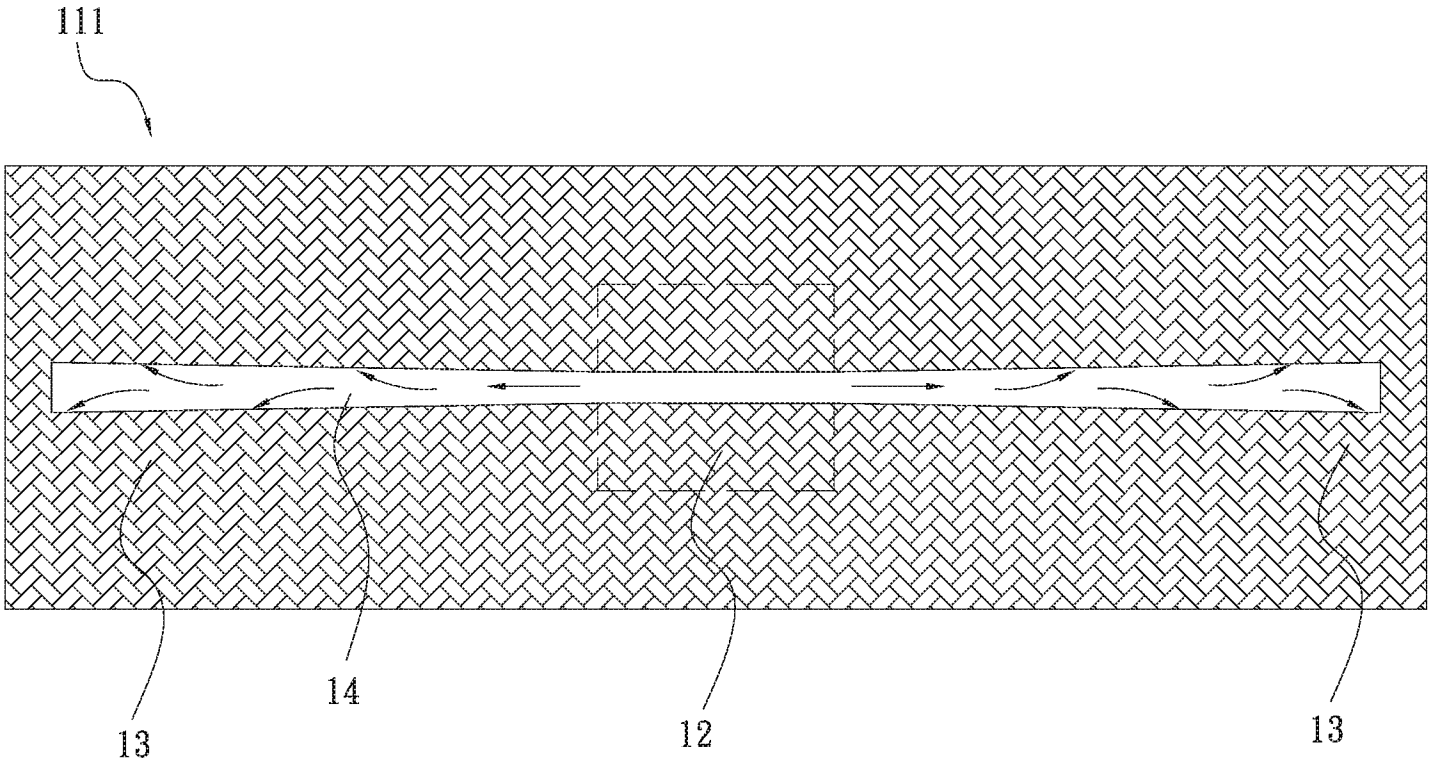
FIG. 7 is an assembled sectional view of the thin heat pipe structure according to a fifth embodiment of the present embodiment.

Please refer to FIG. 7, which is an assembled sectional view of the thin heat pipe structure according to a fifth embodiment of the present embodiment. As shown, the fifth embodiment of the thin heat pipe structure is generally structurally similar to the fourth embodiment except that, in this fifth embodiment, the width of the groove 14 is gradually increased from the evaporating section 12 towards the condensing sections 13. That is, the width of the groove 14 in the evaporating section 12 is smaller than that of the groove 14 in the condensing sections 13, which means that the groove 14 used as a vapor passageway has a gradually increased width towards the condensing sections 13.

Figure 8:
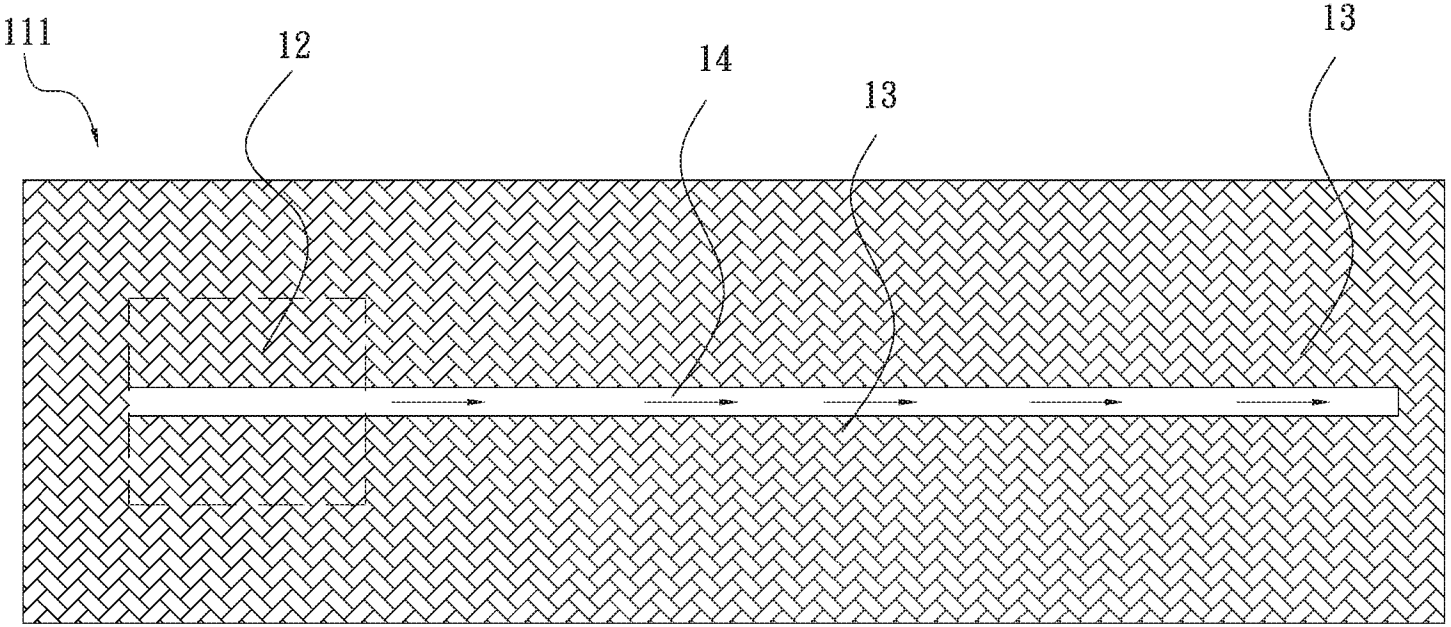
FIG. 8 is an assembled sectional view of the thin heat pipe structure according to a sixth embodiment of the present embodiment.

Please refer to FIG. 8, which is an assembled sectional view of the thin heat pipe structure according to a sixth embodiment of the present embodiment. As shown, the sixth embodiment of the thin heat pipe structure is generally structurally similar to the first embodiment except that, in this sixth embodiment, the groove 14 is extended through the wick structure 111 in the condensing section 13 and the evaporating section 12 along the thickness direction Y of the main body 1.

Figure 9:
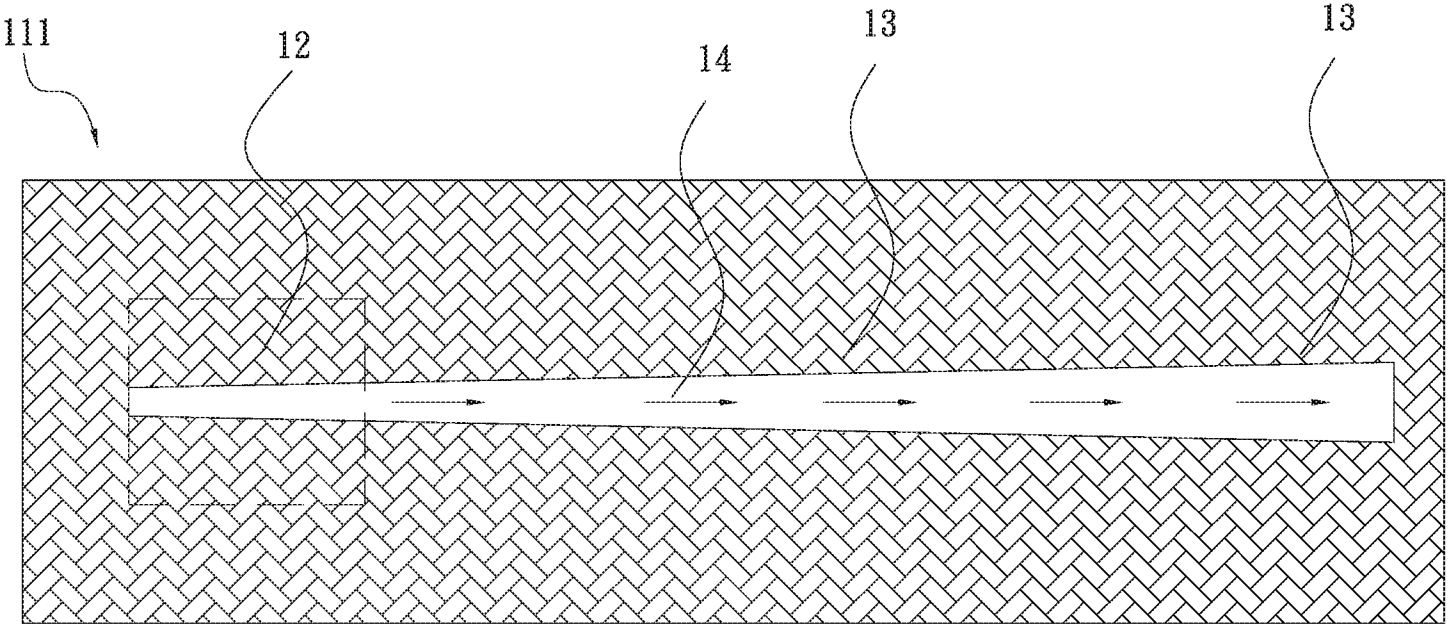
FIG. 9 is an assembled sectional view of the thin heat pipe structure according to a seventh embodiment of the present embodiment.

Please refer to FIG. 9, which is an assembled sectional view of the thin heat pipe structure according to a seventh embodiment of the present embodiment. As shown, the seventh embodiment of the thin heat pipe structure is generally structurally similar to the sixth embodiment except that, in this seventh embodiment, the width of the groove 14 is gradually increased from the evaporating section 12 towards the condensing section 13, meaning that the groove 14 used as a vapor passageway has a gradually increased width towards the condensing section 13.

In the above seven embodiments, the wick structure may be meshes, fibers, or woven threads. Also, the main body 1 further includes a first plate member 1*a* and a second plate member 1*b*. The first and the second plate member 1*a*, 1*b* are closed to each other to sandwich the wick structure 111 therebetween. In the present invention, the first and the second plate member 1*a*, 1*b* respectively have a thickness ranged from 0.01 to 0.1 mm and the wick structure 111 has a thickness ranged from 0.05 to 0.2 mm.

In the above illustrated embodiments, the thin heat pipe structure is provided with one groove 14. However, it is understood more grooves 14 can be provided without being limited to one. Further, the first and the second plate member 1*a*, 1*b* are made of a metal material, such as a copper-foil, an aluminum foil, a stainless steel sheet, or any other thermally conductive metal alloy sheet.

The present invention has been described with some preferred embodiments thereof and it is understood that many changes and modifications in the described embodiments can be carried out without departing from the scope and the spirit of the invention that is intended to be limited only by the appended claims.

What is claimed is:

1. A flat heat pipe structure comprising:

a main body including a chamber comprising a first plate member and a second plate member; the first and second plate members being flat and sealed to each other along a perimeter thereof to form the chamber, the chamber disposed between the first and second plate members and comprising a space to sandwich a completely flat wick structure and a working fluid within the chamber, the wick structure internally defining an evaporating section and at least two condensing sections; the at least two condensing sections being respectively extended from two opposite ends of the evaporating section; the wick structure being provided with a composite groove, having a first groove segment, a second groove segment and a third groove segment, the first groove segment, the second groove segment and the third groove segment in communication with each other and extended through a top side and a bottom side of the wick structure, the first groove segment disposed on a central section and extending through the evaporating section, the second groove segment and the third groove segment respectively communicating with the first groove segment and extending through the at least two condensing sections, wherein the composite groove comprises no bending, a width dimension of the composite groove gradually increases from a lesser width at a junction with the first groove segment to a greater width in the second groove segment and the third groove segment, two sides of the completely flat wick structure are respectively and entirely attached to an inner side of the first plate member and an inner side of the second plate member, a heat generation component is attached to the first plate member or the second plate member, and where an outer surface of the first plate member or the second plate member that is in contact with the heat generation component is completely flat.

2. The thin heat pipe structure as claimed in claim 1, wherein the wick structure is selected from the group consisting of meshes, fibers, and woven threads.

* * * * *